US012201149B2

(12) United States Patent
Chwaja

(10) Patent No.: US 12,201,149 B2
(45) Date of Patent: Jan. 21, 2025

(54) VOLCANO EXTRACT BOWL

(71) Applicant: Michal Chwaja, Coquitlam (CA)

(72) Inventor: Michal Chwaja, Coquitlam (CA)

( * ) Notice: Subject to any disclaimer, the term of this patent is extended or adjusted under 35 U.S.C. 154(b) by 232 days.

(21) Appl. No.: 17/578,475

(22) Filed: Jan. 19, 2022

(65) Prior Publication Data

US 2023/0225400 A1 Jul. 20, 2023

(51) Int. Cl.

| | |
|---|---|
| ***A24F 40/42*** | (2020.01) |
| *A24F 1/30* | (2006.01) |
| *A24F 5/04* | (2006.01) |
| *A24F 5/10* | (2006.01) |

(52) U.S. Cl.

CPC ..... *A24F 40/42* (2020.01); *A24F 1/30* (2013.01); *A24F 5/04* (2013.01); *A24F 5/10* (2013.01)

(58) Field of Classification Search

CPC ..... A24F 5/00–5/14; A24F 1/30; A24F 40/42; A24D 1/14

See application file for complete search history.

(56) References Cited

U.S. PATENT DOCUMENTS

| | | | | |
|---|---|---|---|---|
| 458,149 | A * | 8/1891 | Anderson | A24F 5/08 131/205 |
| 2,211,166 | A * | 8/1940 | Ross | A24F 7/04 131/202 |
| 2,630,808 | A * | 3/1953 | Kraber | A24F 7/00 131/228 |
| 6,513,524 | B1 * | 2/2003 | Storz | A61M 16/208 128/203.29 |
| 10,973,261 | B2 * | 4/2021 | Crowe | H05B 3/44 |
| 2011/0094524 | A1 * | 4/2011 | Glover | A24F 1/32 131/224 |
| 2017/0055579 | A1 * | 3/2017 | Kuna | A24F 1/00 |
| 2018/0110938 | A1 * | 4/2018 | Trzecieski | A61L 9/00 |
| 2021/0307385 | A1 * | 10/2021 | Franzone | A24F 40/05 |
| 2022/0232893 | A1 * | 7/2022 | Jaeger | A24F 40/57 |
| 2022/0304392 | A1 * | 9/2022 | Hoch | A24F 40/46 |

FOREIGN PATENT DOCUMENTS

| | | | | |
|---|---|---|---|---|
| GB | 2141017 | A * | 12/1984 | A24F 19/0078 |

OTHER PUBLICATIONS

Hazekamp et al., "Evaluation of a Vaporizing Device (Volcano®) for the Pulmonary Administration of Tetrahydrocannabinol", Journal of Pharmaceutical Sciences, vol. 95, 1308-1317 (2006). (Year: 2006).*

(Continued)

*Primary Examiner* — Michael H. Wilson
*Assistant Examiner* — Ardith Elyse Hertzog
(74) *Attorney, Agent, or Firm* — David J. Connaughton, Jr.; Justin P. Tinger; Yafei Xue

(57) ABSTRACT

The Volcano Extract Bowl allows an individual to Vaporize extracts with the Volcano Vaporizer. It transforms the Volcano Vaporizer into a Vaporizer that can Vaporize extracts like Rosin, Shatter, oils, Budder, wax, etc. Essentially, this is a Volcano Extract Bowl specifically designed to work with the Volcano Vaporizer by Storz and Bickel®.

1 Claim, 16 Drawing Sheets

(56) References Cited

OTHER PUBLICATIONS

Storz & Bickel® Volcano Classic Instructions for use, download available at https://www.storz-bickel.com/en-US/amfile/file/download/file/34/, accessed Oct. 26, 2023: front and back cover, English language pp. 46-87, copyright Apr. 2022. (Year: 2022).*

What Are Carb Caps and Should You Be Using Them? Mar. 1, 2016, by Lukas W, available at: https://herb.co/learn/what-are-carb-caps-and-should-you-be-using-them/ (Year: 2016).*

Reddit post: "Anyone else use a coin and a carb cap?", available at https://www.reddit.com/r/Dabs/comments/fp0q6u/anyone_else_use_a_coin_and_a_carb_cap_no_just_me/?rdt=38680, accessed Apr. 24, 2024, date at least as early as Apr. 2020 (i.e., 4 yrs ago) (Year: 2020).*

Replacement Quartz Dish for Hybrid Quartz / Titanium Nails—QuartzBangers.com, available at: https://www.quartzbangers.com/products/replacement-quartz-dish-for-hybrid-quartz-titanium-nails, accessed Apr. 19, 2024, date at least as early as Mar. 23, 2021 (see last comment on p. 3) (Year: 2021).*

* cited by examiner

VOLCANO EXTRACT BOWL

This invention transforms the Storz & Bickel® Volcano Vaporizer 5 into a Vaporizer that can Vaporize extracts like Rosin, Shatter, oils, Budder, wax, etc. Essentially, this invention is a Volcano Extract Bowl 1. The measurements for this invention are 1.5 cm high and 2.5 cm wide circular Glass Bowl 3 with an elevated circular 1 cm wide hole 4 directly in the middle where hot air 465 E can pass through. The circular 1 cm wide hole 4 is elevated to a height of 1 cm and a Flow Diverting Cap 2 removable secured is placed on top of the elevated hole 4. The Flow Diverting Cap 2 is 1.7 cm wide circular metal flat top 9 cap with a spring loaded circular eight-legged 7.7 mm long Fixing Clip 10 that allows hot air to be easily diverted through the eight 0.2 cm wide slit 11 openings located in between each spring-loaded clip leg 8. Each clip leg 8 is arranged around the circumference of the bottom of the circular flat top 9 and are extending down to a length of 0.7 cm. The extract is placed inside the 2.5 cm wide Glass Bowl 3 inside wall and the outside wall of the 1 cm elevated circular 1 cm wide hole. You place the Volcano Extract Bowl inside the Volcano Chamber Housing 6 and place the Volcano Chamber Housing 6 with the Volcano Extract Bowl inside, on top of the Storz & Beckel® Volcano Vaporizer heating core 7. When the 465 F degree air pushes out of the Volcano Vaporizer heating core 7 and through the elevated hole 4, it gets diverted by the Flow Diverting Cap causing maximum turbulence and heat exchange. Due to this process the inside of the Volcano Vaporizer Chamber Housing 6 heats up to 465 F and simultaneously heats up the Volcano Extract Bowl and the extract in it to the same degree, causing the extract to vaporize. The vaporized extract vapers get pushed out of the Volcano Vaporizers Chamber Housing 6 Exhaust.

BRIEF DESCRIPTION OF THE DRAWINGS

In "FIG. 1" we have a front view of the Volcano Extract Bowl. In "FIG. 2" we have an elevated front view of the Extract Bowl and the Flow Diverting Cap removed. In "FIG. 3" we have an elevated front left view of the Extract Bowl and the Flow Diverting Cap removed. In "FIG. 4" we have an elevated side view of the Extract Bowl and the Diverting Cap removed. In "FIG. 5" we have a front view of the Flow Diverting Cap. In "FIG. 6" we have an elevated front left view of the Extract Bowl and the Flow Diverting Cap upside down and removed. In "FIG. 7" we have a top view of the Extract Bowl and the Flow Diverting Cap removed. In "FIG. 8" we have an elevated front view of the Extract Bowl and the Flow Diverting Cap removed. In "FIG. 9" we have a front view of the Volcano Extract Bowl. In "FIG. 10" we have an elevated back right view of the Volcano Extract Bowl placed on its side. In "FIG. 11" we have an elevated front right view of the Volcano Extract Bowl placed on its side. In "FIG. 12" we have an elevated front view of the Volcano Extract Bowl placed on its side. In "FIG. 13" we have a front view of the Volcano Extract Bowl placed on the Volcano Vaporizer Heating Core with the Volcano Chamber Housing removed. In "FIG. 14" we have an elevated front view of the Volcano Extract Bowl placed on Volcano Vaporizer Heating Core. In "FIG. 15" we have an elevated front view of the Volcano Extract Bowl placed on the Volcano Vaporizer Heating Core with the bottom part of the Volcano Chamber Housing over top the Volcano Extract Bowl. In "FIG. 16" we have an elevated front view of the Volcano Chamber Housing over top and covering the Volcano Extract Bowl and the Volcano Heating Core.

Figure 1:
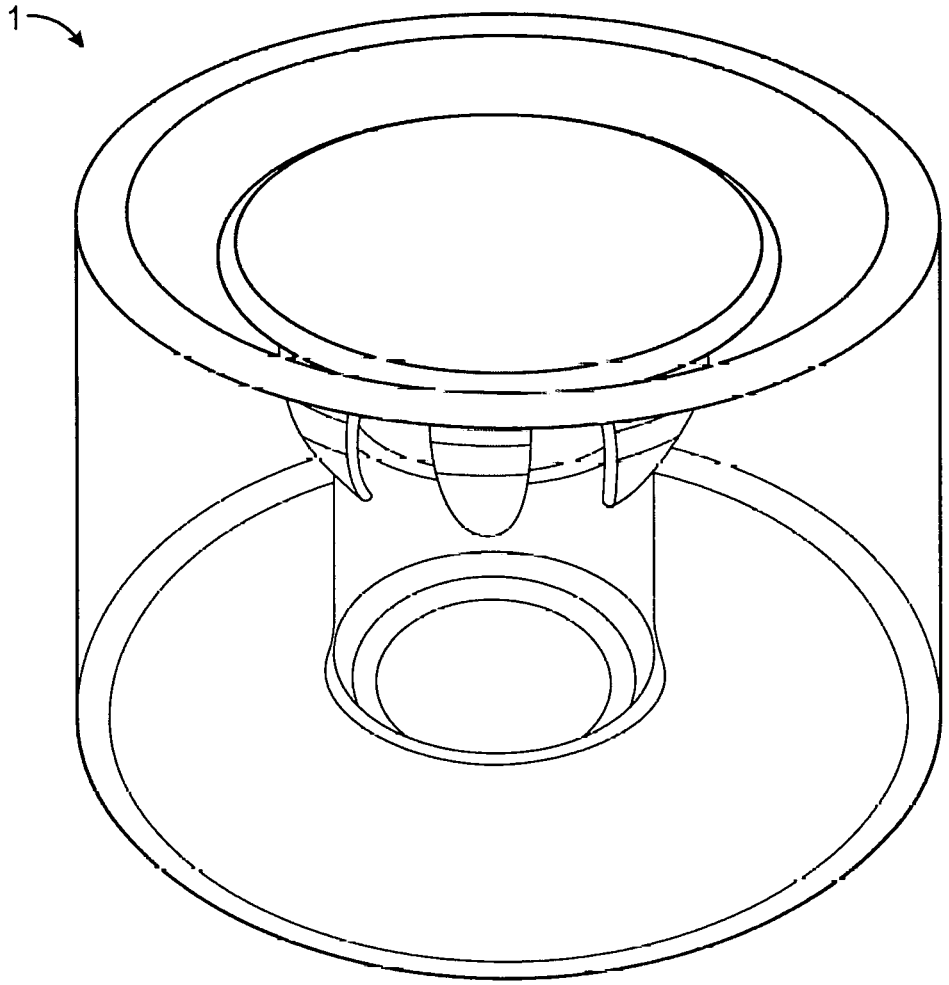
Figure 2:
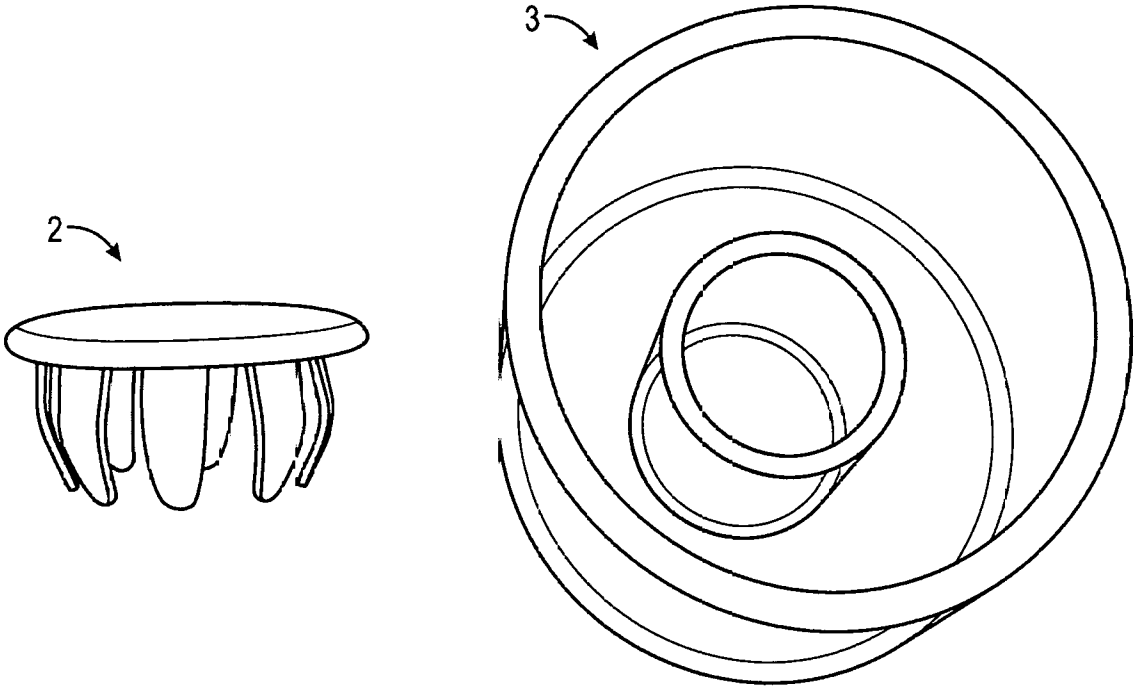
Figure 3:
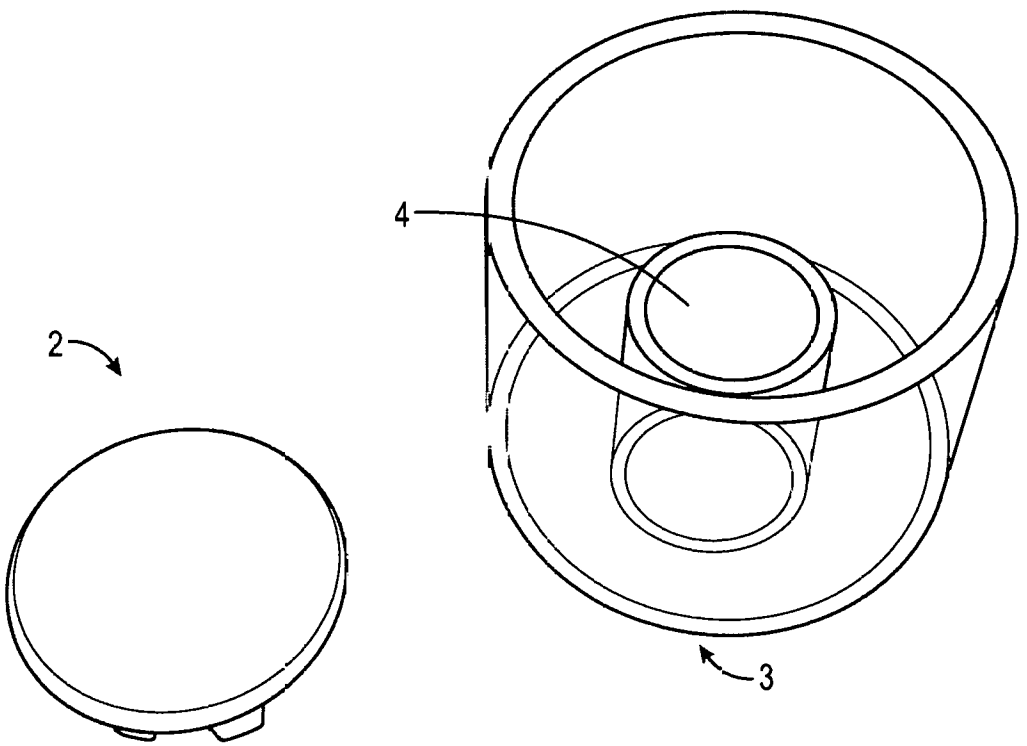
Figure 4:
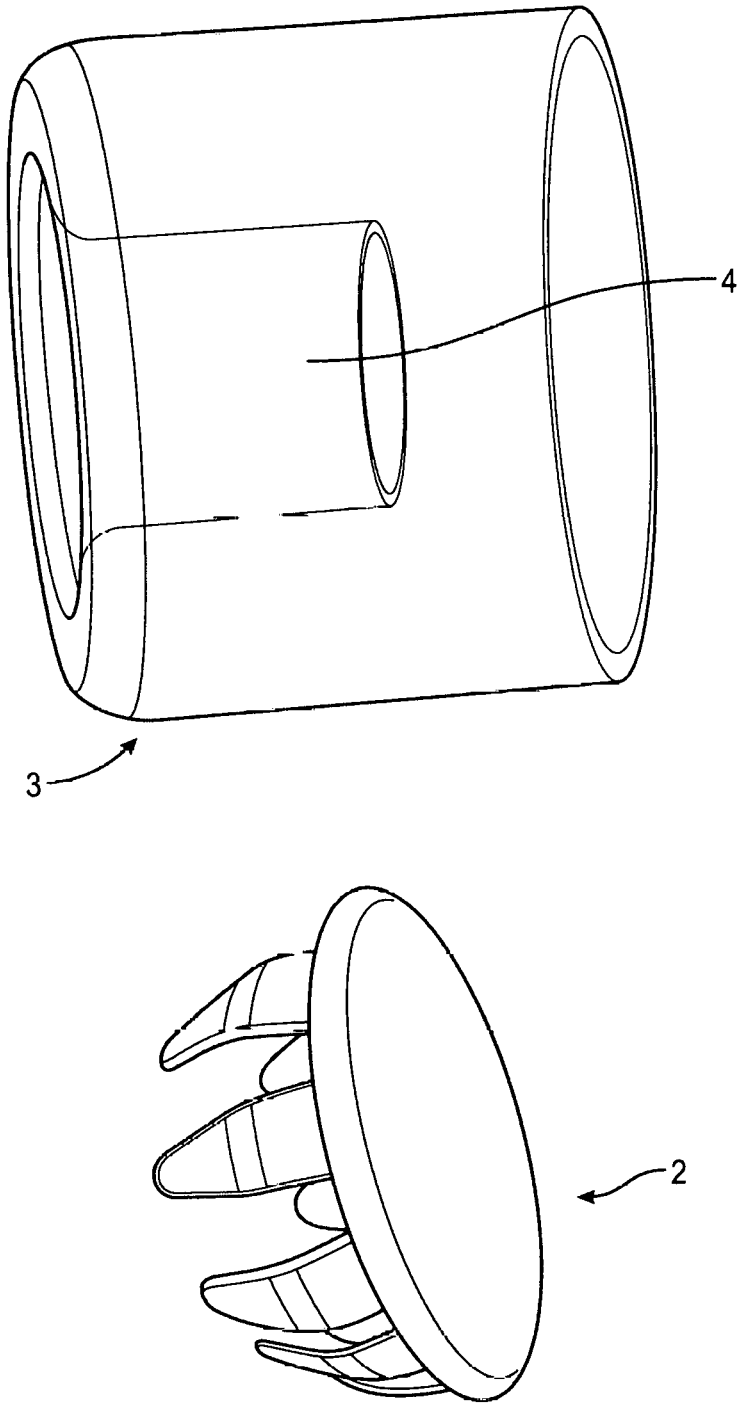
Figure 5:
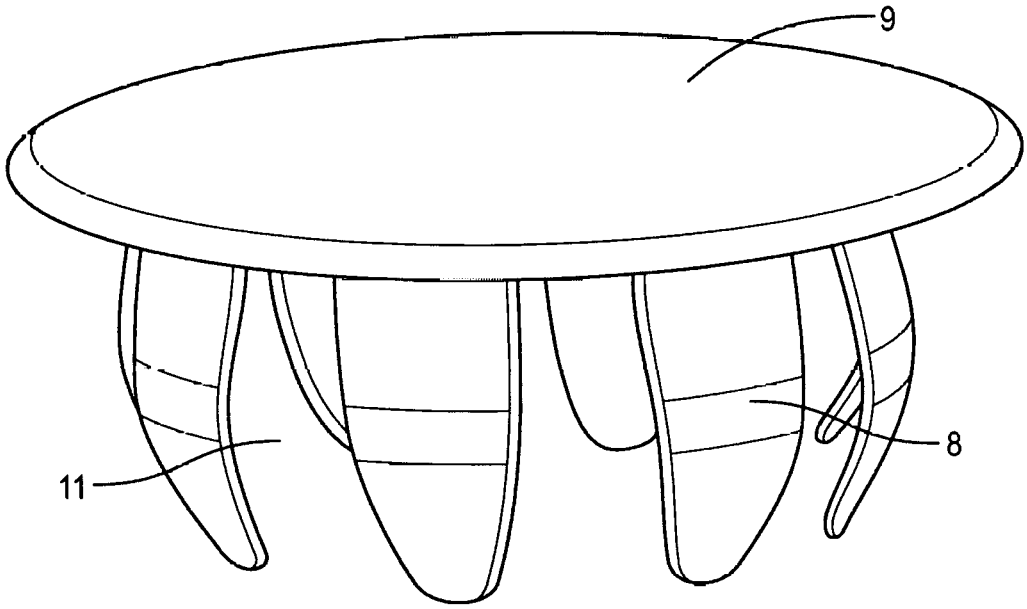
Figure 6:
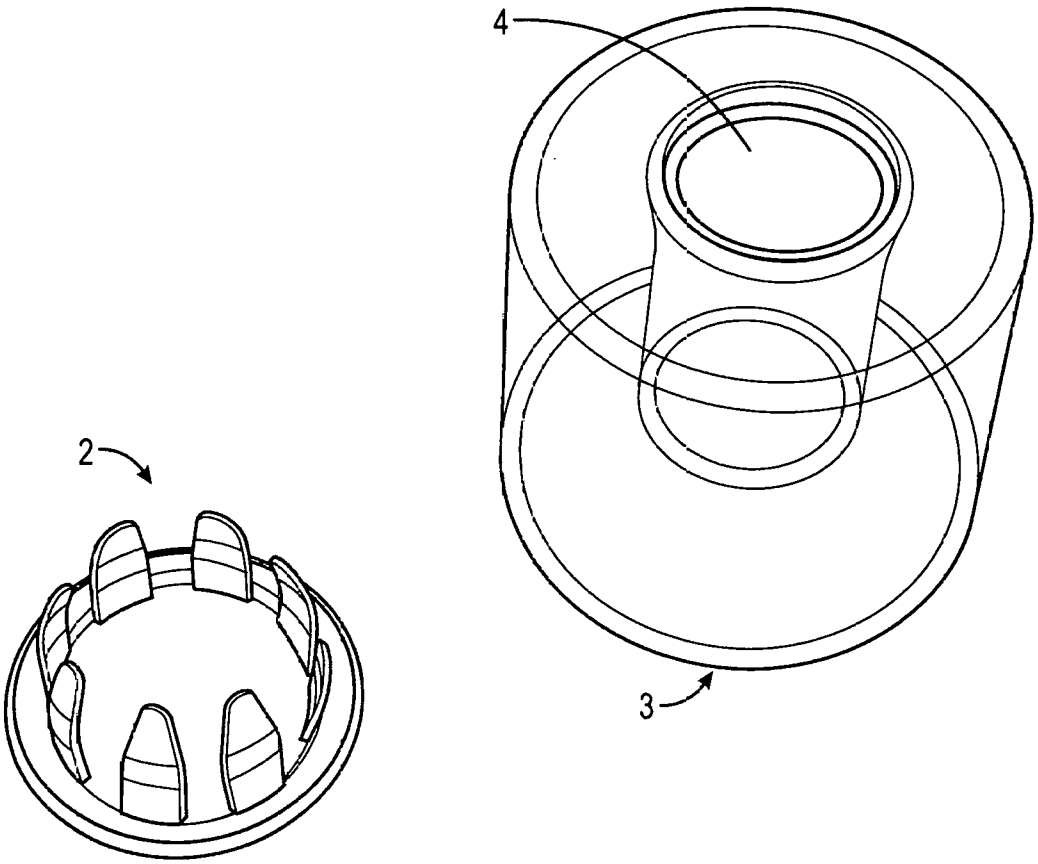
Figure 7:
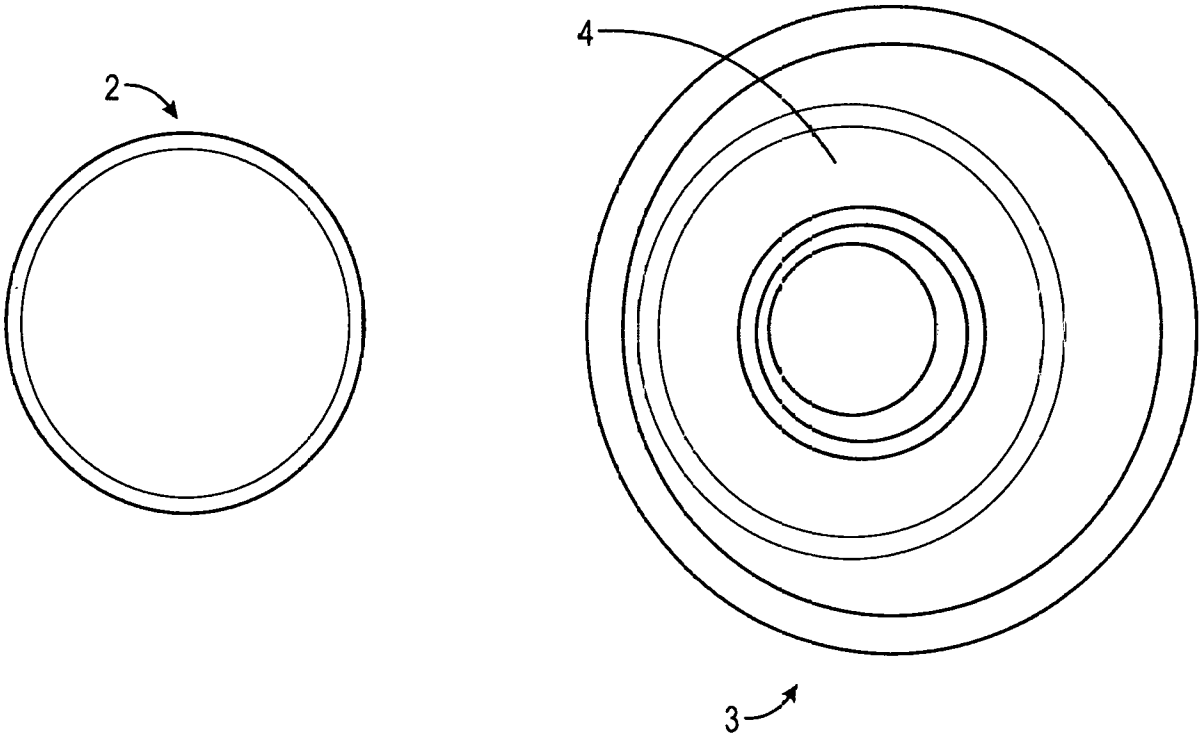
Figure 8:
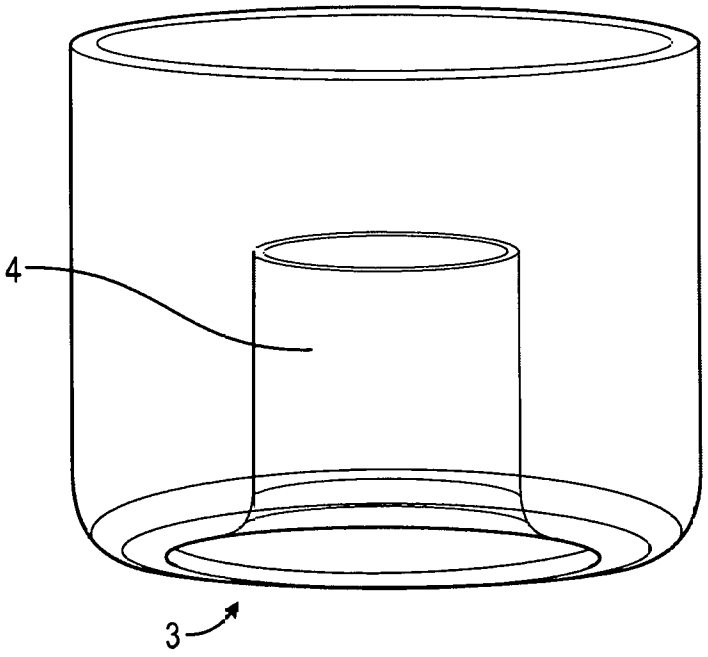
Figure 8:
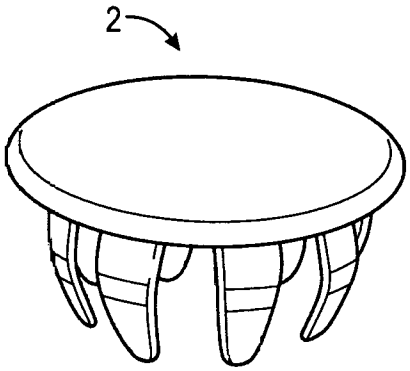
Figure 9:
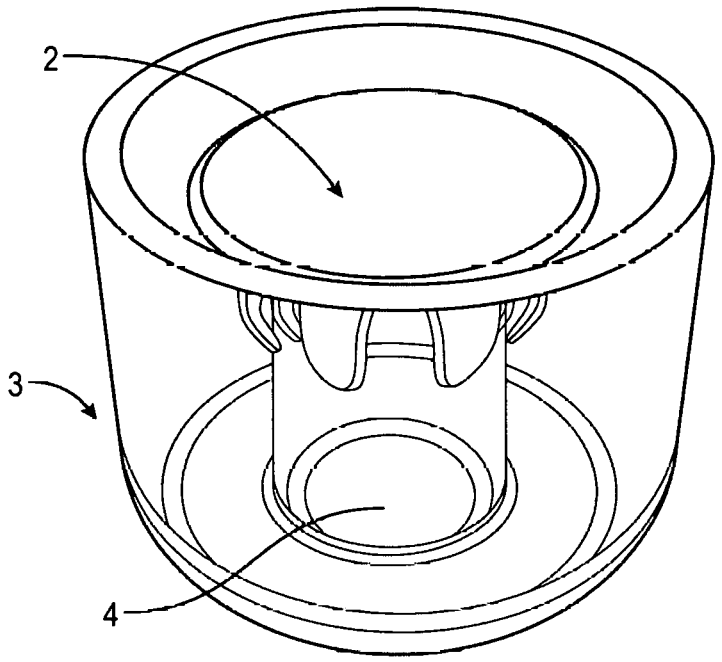
Figure 10:
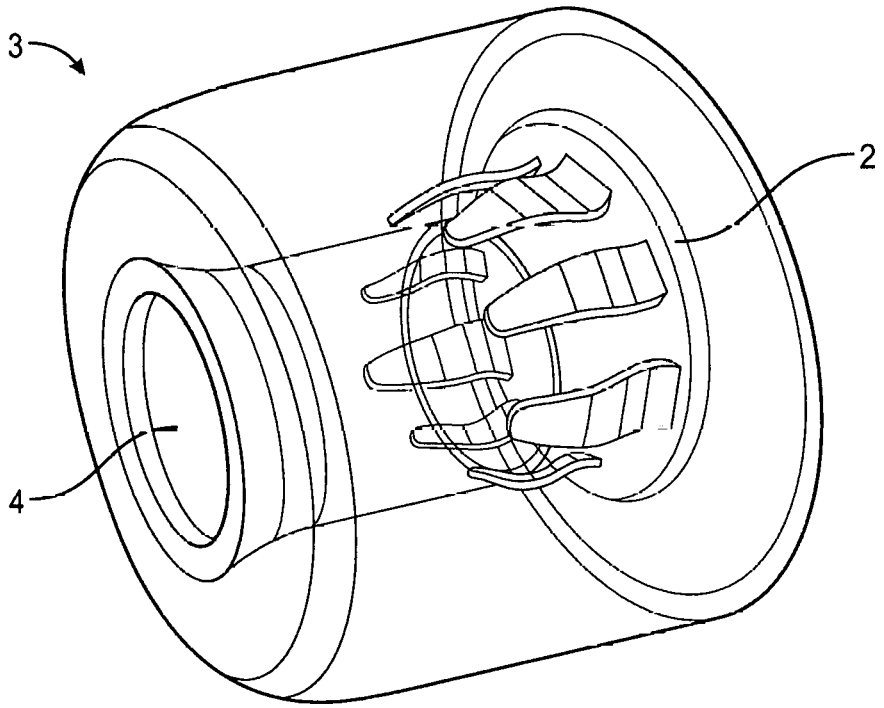
Figure 11:
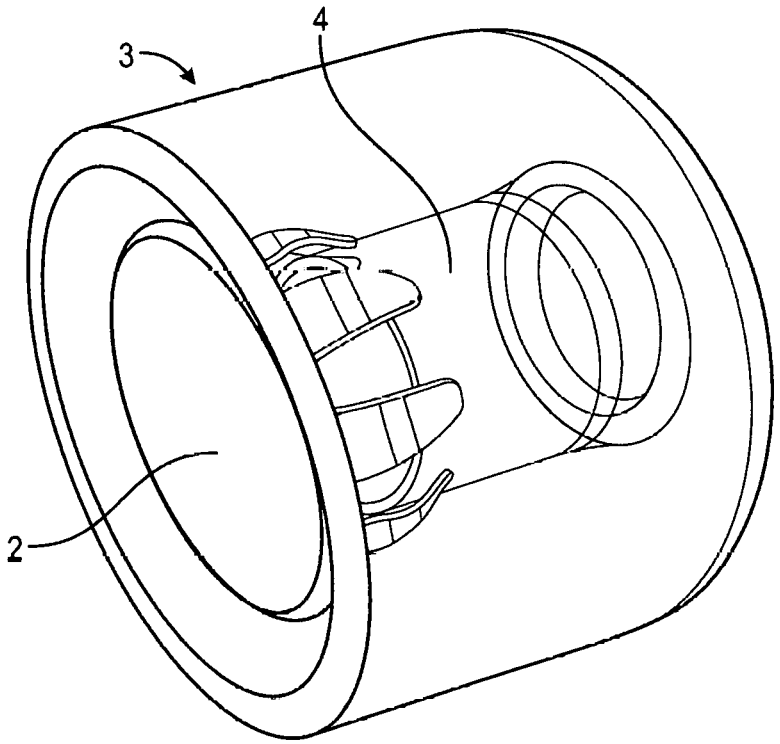
Figure 12:
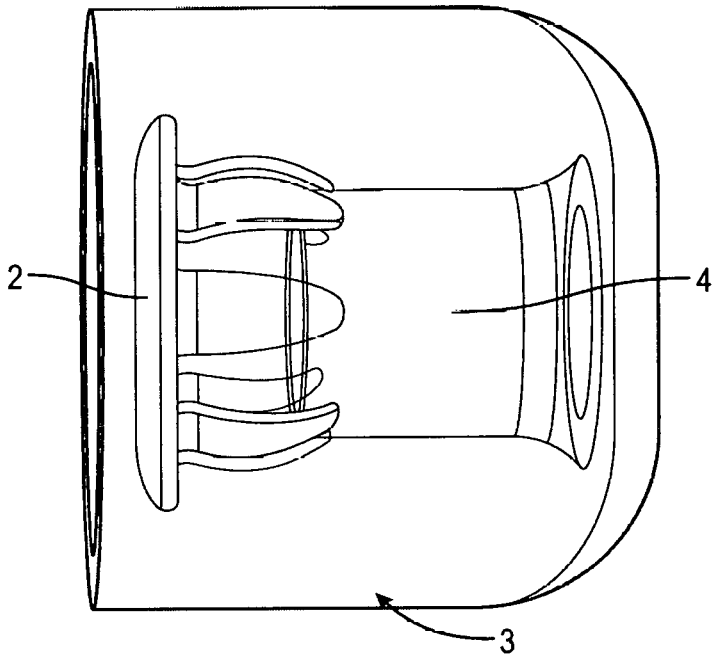
Figure 13:
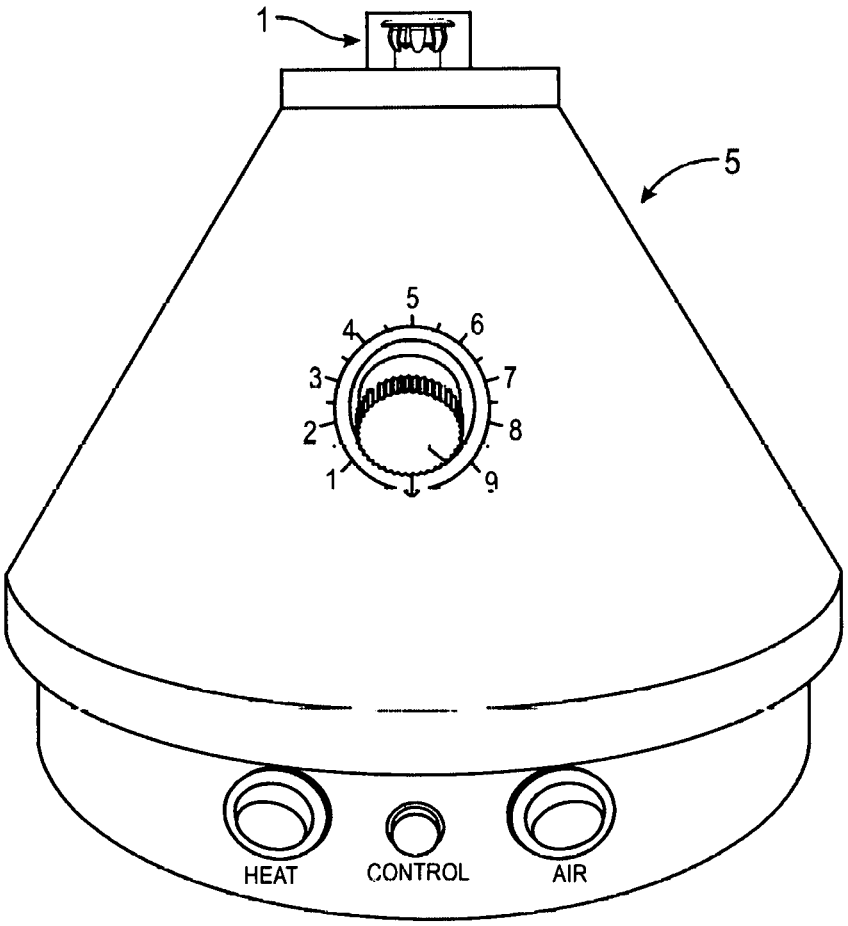
Figure 14:
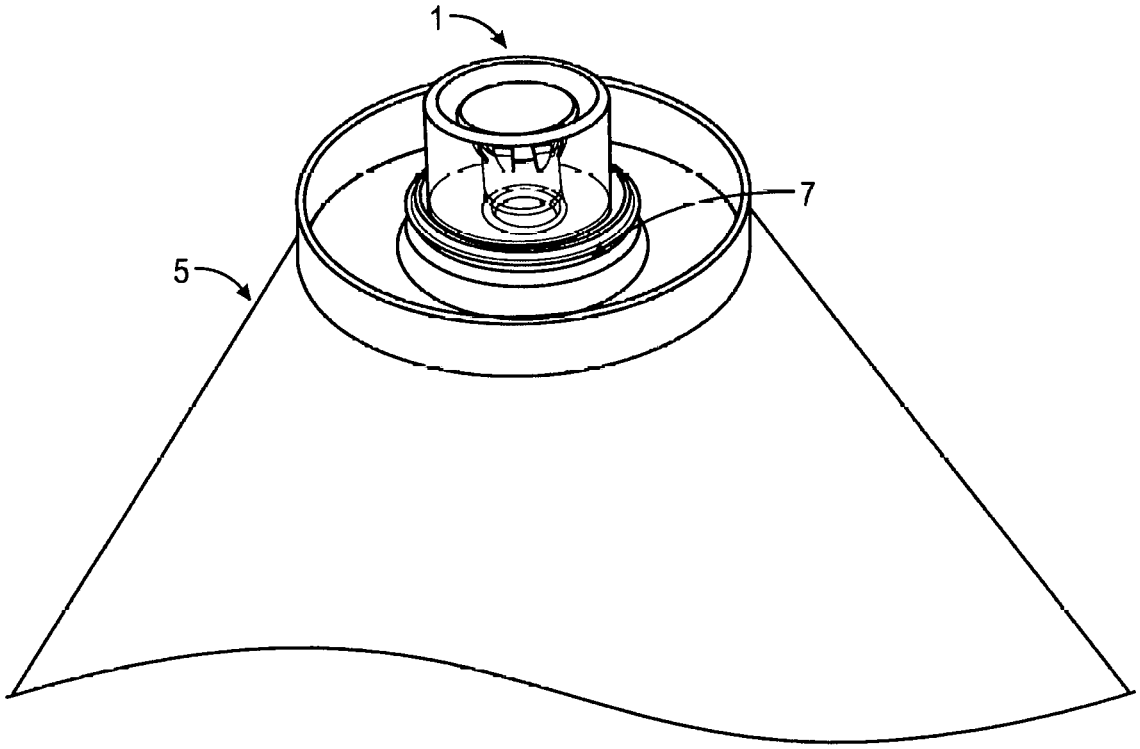
Figure 15:
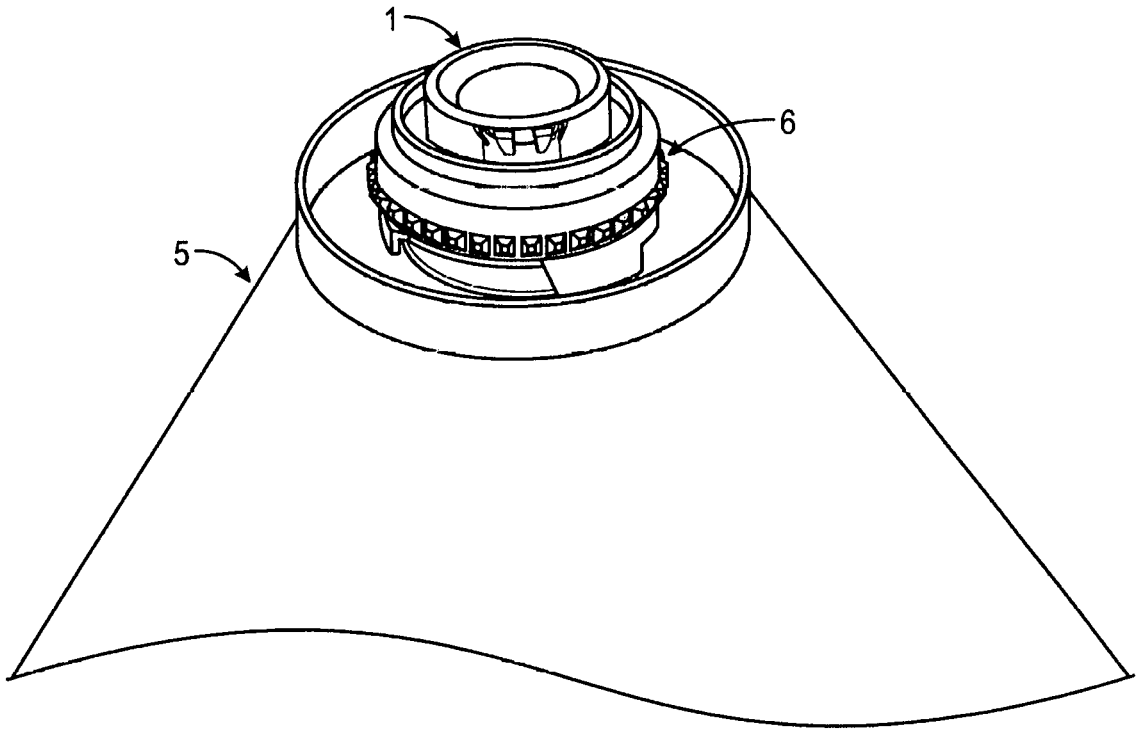
Figure 16:
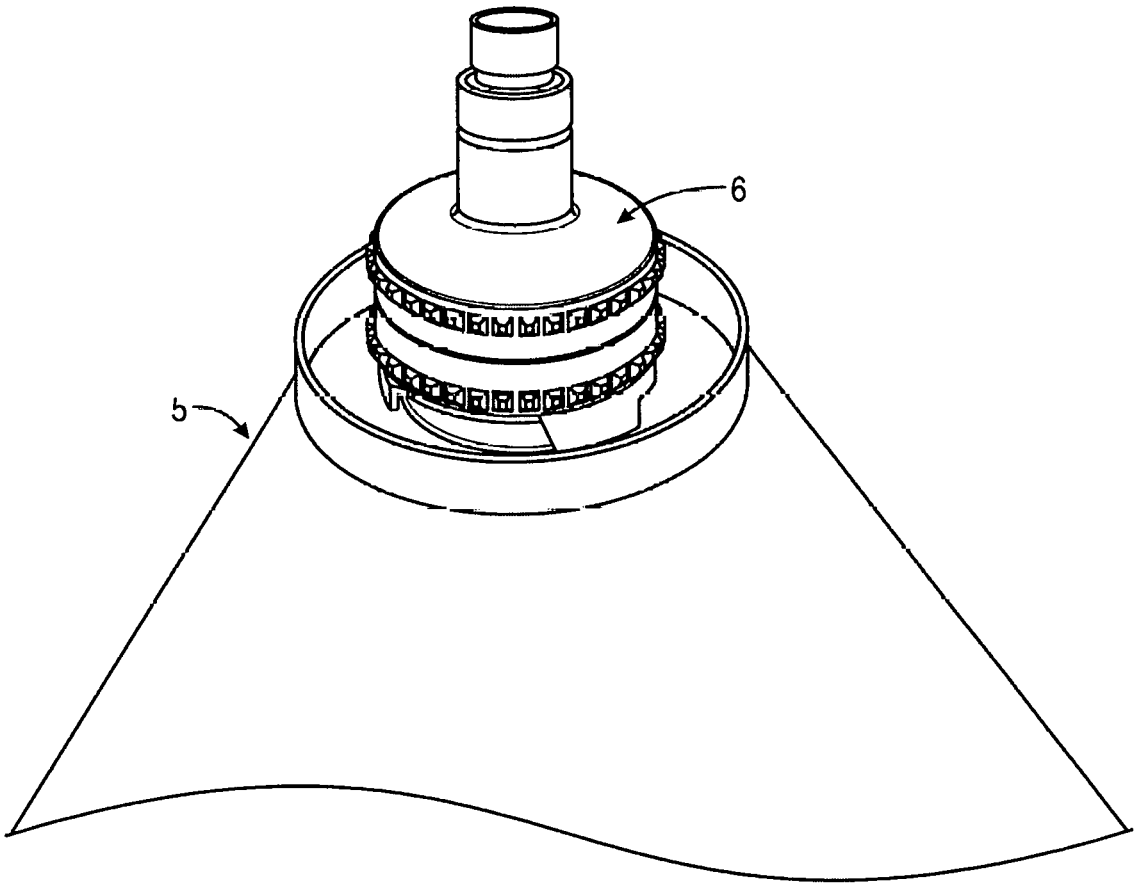

The invention claimed is:

1. A volcano vaporizer, comprising:

a glass bowl with an elevated hole located in the middle;

wherein, the glass bowl is circular, 1.5 cm high and 2.5 cm wide;

wherein, the elevated hole is circular and secured to the glass bowl;

wherein, the elevated hole is 1 cm wide and elevated to a height of 1 cm;

a flow-diverting cap, detachably secured to a top of the elevated hole;

wherein, the flow-diverting cap is 1.7 cm wide and includes a circular, metal, and flat top cap with a spring-loaded, circular fixing clip with eight legs that are 0.7 cm long and eight slit openings between the eight legs, each 0.2 cm wide;

wherein, the legs are arranged around a circumference of a bottom of the circular, metal, and flat top cap and extend downwards;

wherein, an extract is placed between an inner wall of the glass bowl and an outer wall of the elevated hole;

wherein a quantity of hot air at 465 F, is caused to travel upward through the elevated hole and gets diverted by the flow-diverting cap at the top of the elevated hole, passing through the plurality of openings, and heats the extract, causing the extract to vaporize, the vaporizer further comprising:

a chamber with an air outlet;

wherein the glass bowl is attached to the air outlet;

a heating unit capable of heating the hot air to 465 F;

a control unit;

a fan.

* * * * *